US006727931B2

(12) United States Patent
Fisher

(10) Patent No.: US 6,727,931 B2
(45) Date of Patent: Apr. 27, 2004

(54) PREVENTING CREASE FORMATION IN DONOR WEB IN DYE TRANSFER PRINTER THAT CAN CAUSE LINE ARTIFACT ON PRINT

(75) Inventor: Terrence L. Fisher, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/242,248

(22) Filed: Sep. 12, 2002

(65) Prior Publication Data

US 2004/0051772 A1 Mar. 18, 2004

(51) Int. Cl.[7] ..... B41J 33/00; B41J 2/325
(52) U.S. Cl. ..... 347/176; 347/219
(58) Field of Search ..... 347/176, 217, 347/216, 218, 219; 400/248, 225, 88, 234, 618, 242, 246

(56) References Cited

U.S. PATENT DOCUMENTS 5,284,396 A * 2/1994 Masumura et al. ..... 400/234
5,918,989 A * 7/1999 Stout et al. ..... 400/88
5,938,350 A * 8/1999 Colonel ..... 400/234
6,326,991 B1 * 12/2001 Kinjyo et al. ..... 347/216
6,380,964 B1 * 4/2002 Tanaka ..... 347/217

FOREIGN PATENT DOCUMENTS

JP 404244871 A * 9/1992 ..... B41J/11/04
JP 407178993 A * 7/1995 ..... B41J/17/30

* cited by examiner

*Primary Examiner*—K. Feggins
(74) *Attorney, Agent, or Firm*—Roger A. Fields

(57) ABSTRACT

In a dye transfer printer, a donor web having successive dye transfer areas that are used for printing and opposite longitudinal edge areas alongside each one of the dye transfer areas that are not used for printing are wrapped under longitudinal tension about a cylindrical spool core. The dye transfer areas that are wrapped under tension about the spool core are stretched thinner than the two edge areas that are wrapped under tension about the spool core due to their being heated during printing. The spool core is depressible inward at respective portions on which the two edge areas are wrapped under tension and is not depressible at an intermediate portion between the depressible portions on which the thinner transfer areas are wrapped under tension. As a result, a convolution build-up of the edge areas on the spool core will be no more than a convolution build-up of the thinner transfer areas on the spool core. This substantially reduces the likelihood of any creases being created in the dye transfer areas which would cause line artifacts to be printed on a dye receiver.

15 Claims, 13 Drawing Sheets

1

PREVENTING CREASE FORMATION IN DONOR WEB IN DYE TRANSFER PRINTER THAT CAN CAUSE LINE ARTIFACT ON PRINT

CROSS REFERENCE TO RELATED APPLICATIONS

Reference is made to commonly assigned co-pending applications Ser. No. 10/242,241 entitled PREVENTING CREASE FORMATION IN DONOR WEB IN DYE TRANSFER PRINTER THAT CAN CAUSE LINE ARTIFACT ON PRINT, filed concurrently herewith in the name of Terrence L. Fisher; Ser. No. 10/242,210 entitled PREVENTING CREASE FORMATION IN DONOR WEB IN DYE TRANSFER PRINTER THAT CAN CAUSE LINE ARTIFACT ON PRINT, filed concurrently herewith in the name of Terrence L. Fisher; Ser. No. 10/242,262 entitled PREVENTING CREASE FORMATION IN DONOR WEB IN DYE TRANSFER PRINTER THAT CAN CAUSE LINE ARTIFACT ON PRINT, filed concurrently herewith in the names of Terrence L. Fisher and Richard Salter; and Ser. No. 10/242,263 entitled PREVENTING CREASE FORMATION IN DONOR WEB IN DYE TRANSFER PRINTER THAT CAN CAUSE LINE ARTIFACT ON PRINT, filed concurrently herewith in the name of Terrence L. Fisher.

FIELD OF THE INVENTION

The invention relates generally to dye transfer printers such as thermal printers, and in particular to the problem of crease formation in the dye transfer area of a donor web used in the printer. Crease formation in the dye transfer area can result in an undesirable line artifact being printed on a dye receiver.

BACKGROUND OF THE INVENTION

A typical multi-color donor web that is used in a thermal printer is substantially thin and has a repeating series of three different color sections or patches such as a yellow color section, a magenta color section and a cyan color section. Also, there may be a transparent laminating section after the cyan color section.

Each color section of the donor web consists of a dye transfer area that is used for dye transfer printing and pair of longitudinal edge areas alongside the transfer area which are not used for printing. The dye transfer area is about 95% of the web width and the two edge areas are each about 2.5% of the web width.

To make a print, the various color dyes in the dye transfer areas of a single series of yellow, magenta and cyan color sections on a donor web are successively heat-transferred by a print head onto a dye receiver such as paper or transparency sheet or roll. The dye transfer from each transfer area to the dye receiver is done line-by-line widthwise across the transfer area via a bead of selectively heated resistive elements on the print head. The print head makes line contact across the entire width of the color section, but it only heats the dye transfer area, i.e. it does not heat the two edge areas alongside the dye transfer area.

As each color section is used for dye transfer at the print head, the donor web is subjected to a longitudinal tension between a donor supply spool and a donor take-up spool which are rearward and forward of the print head. The longitudinal tension, coupled with the heat from the print head, causes a used color section to be stretched lengthwise at least from the print head to the donor take-up spool. Since the dye transfer area in a used color section has been heated by the print head, but the two edge areas alongside the transfer area have not been heated, the transfer area tends to be stretched more than the edge areas. As a result, the transfer area becomes thinner than the two edge areas and develops a wave-like or ripple distortion widthwise between the edge areas.

After the last line is transferred from a dye transfer area to a dye receiver, and as the used color section is advanced forward from the print head and onto the donor take-up spool, the wave-like or ripple distortion in the transfer area causes one or more creases to form at least in a short trailing or rear end portion of the transfer area that has not been used for dye transfer. The creases tend to spread rearward from the trailing or rear end portion of the used transfer area into a leading or front end portion of an unused transfer area in the next (fresh) color section being advanced to the print head. The creases appear to be created because of the difference in thickness between the used transfer area and the edge areas as they are wound under tension from the print head and onto the donor take-up spool.

When a used color section is wrapped under tension around the donor take-up spool, the edge areas wrap differently on the spool than does the used transfer area because of the difference in thickness between the transfer area and the edge areas. As each additional color section is wrapped around the donor take-up spool, the convolution build-up of the thicker edge areas on the spool becomes significantly greater than the convolution build-up of the thinner transfer areas. This non-uniform winding of the used color section increases the likelihood of one or more creases being created because the convolution build-up of the thicker edge areas on the donor take-up spool adds to the tension and distortion of the used transfer areas.

A problem that can result is that a crease in the leading or front end portion of the unused transfer area of the next (fresh) color section will cause an undesirable line artifact to be printed on a leading or front end portion of the dye receiver when the print head is applied to the crease. The line artifact printed on the receiver is about 0.5 inches in length.

The question presented therefore is how to solve the problem of the creases being created in the unused transfer area of each fresh color section so that no line artifacts are printed on the dye receiver.

SUMMARY OF THE INVENTION

A dye transfer printer in which a donor web having successive dye transfer areas that are used for printing and opposite longitudinal edge areas alongside each one of the dye transfer areas that are not used for printing are wrapped under longitudinal tension about a cylindrical spool core, and in which the dye transfer areas that are wrapped under tension about the spool core have been stretched thinner than the two edge areas that are wrapped under tension about the spool core, is characterized in that:

the cylindrical spool core is depressible inward at respective portions on which the two edge areas are wrapped under tension about the spool core and is not depressible at an intermediate portion between the depressible portions on which the thinner transfer areas are wrapped under tension about the spool core, whereby a convolution build-up of the edge areas on the spool core will be no more than a convolution build-up of the thinner transfer areas on the spool core.

If the convolution build-up of the edge areas on the spool core is no more than the convolution build-up of the thinner transfer areas on the spool core, the likelihood of the creases being created in the unused transfer area of each fresh color section is substantially reduced. Thus, no line artifacts can be printed on the dye receiver.

DETAILED DESCRIPTION OF THE INVENTION

Donor Web

Figure 1:
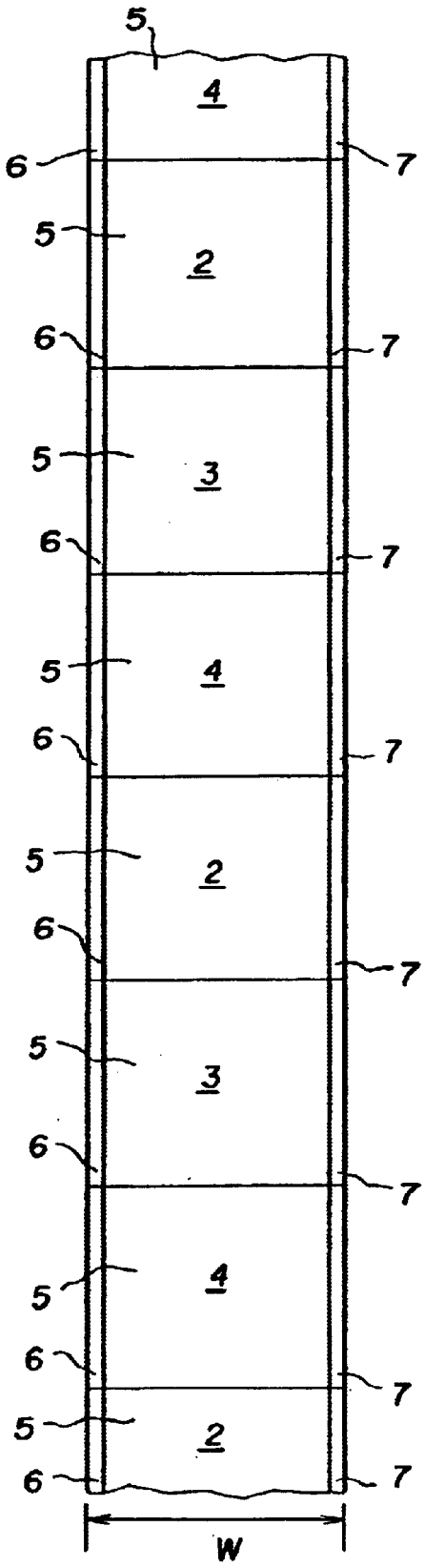
FIG. 1 is plan view of a donor web including successive dye transfer areas and opposite edge areas alongside each one of the dye transfer areas.

FIG. 1 depicts a typical multi-color donor web or ribbon 1 that is used in a thermal color-printer. The donor web 1 is substantially thin and has a repeating series (only two shown) of three different color sections or patches such as a yellow color section 2, a magenta color section 3 and a cyan color section 4. Also, there may be a transparent laminating section (not shown) after the cyan color section 4.

Each one of the successive color sections 2–4 of the donor web 1 consists of a dye transfer area 5 that is used for dye transfer printing and pair of longitudinal edge areas 6 and 7 alongside the transfer area which are not used for printing. The dye transfer area 5 is about 95% of the web width W and the two edge areas 6 and 7 are each about 2.5% of the web width.

Dye Transfer Printer

FIGS. 2–6 depict operation of a known prior art thermal color-printer 10.

Figure 2:
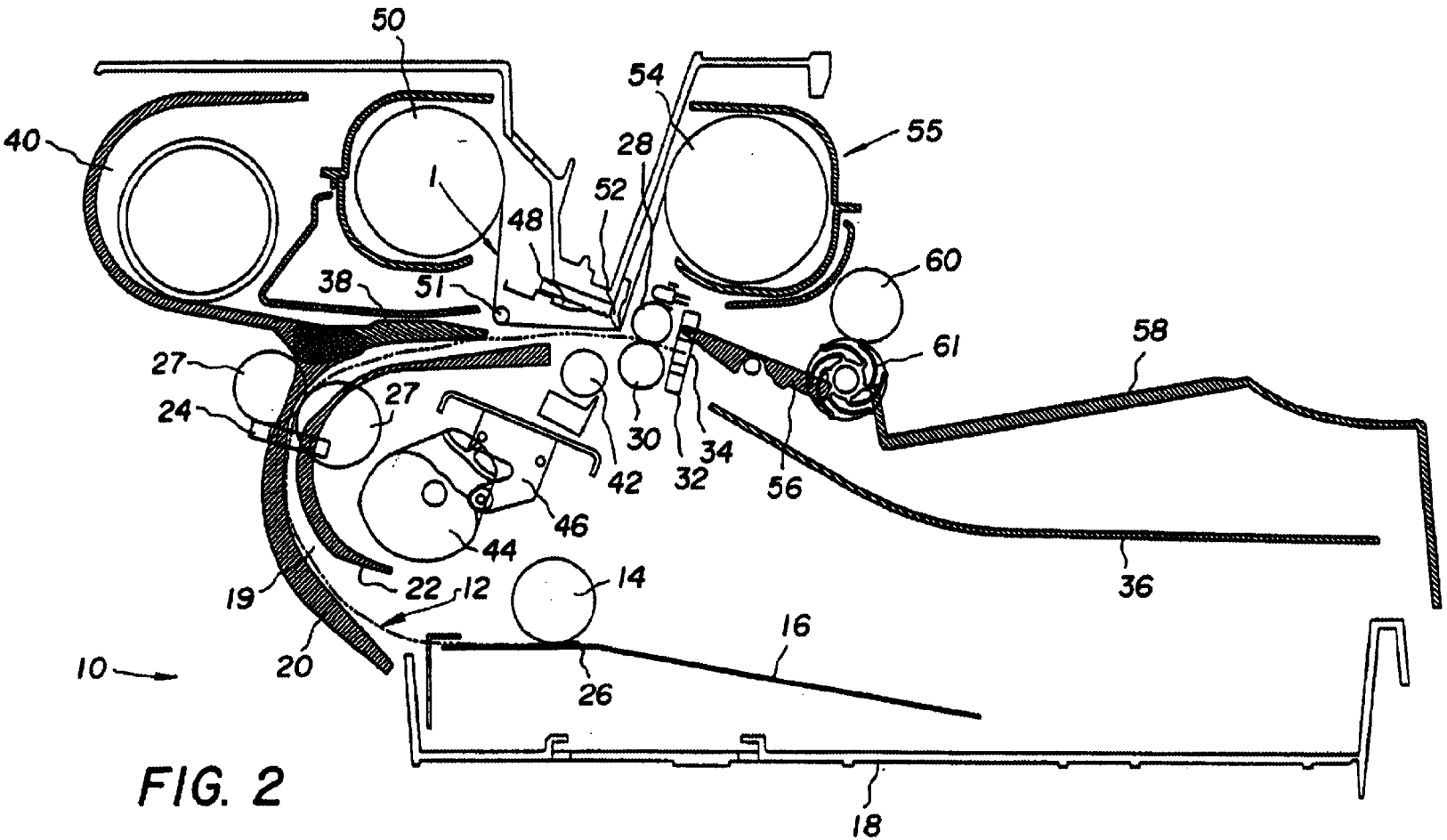
FIG. 2 is an elevation section view, partly in section, of a dye transfer printer, showing a beginning cycle during a printer operation.

Beginning with FIG. 2, a dye receiver sheet 12, e.g. paper or transparency, is initially advanced forward via coaxial pick rollers 14 (only one shown) off a floating platen 16 in a tray 18 and into a channel 19 defined by a pair of curved longitudinal guides 20 and 22. When a trailing (rear) edge sensor 24 midway in the channel 19 senses a trailing or rear edge 26 of the receiver sheet 12, it activates at least one of pair of parallel axis urge rollers 27, 27 in the channel 19. The activated rollers 27, 27 advance the receiver sheet 12 forward through the nip of a capstan roller 28 and a pinch roller 30, positioned beyond the channel 19, and to a leading (front) edge sensor 32.

Figure 3:
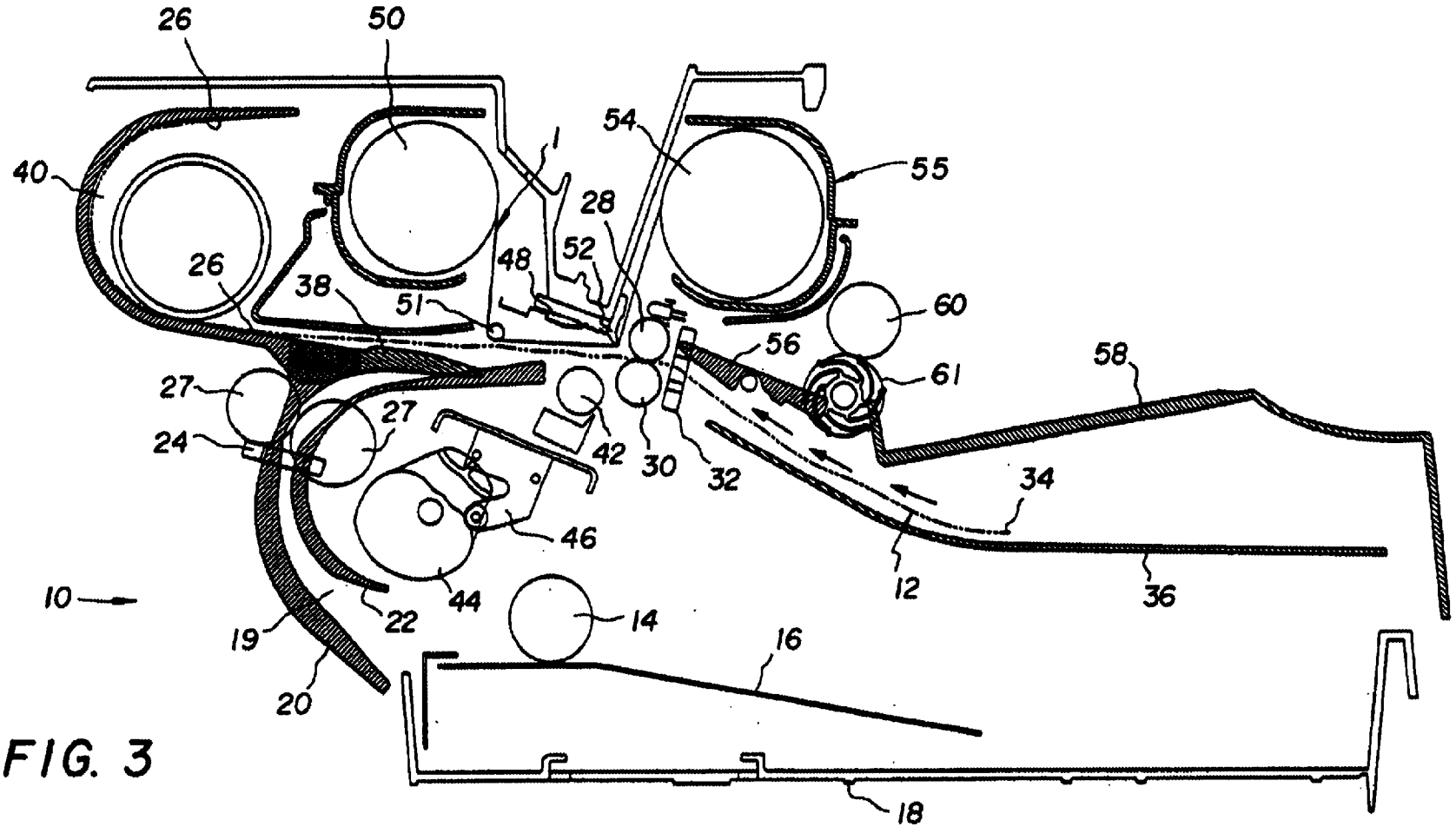
FIGS. 3 and 4 are elevation section views of the dye transfer printer as in FIG. 2, showing other cycles during the printer operation.

In FIG. 3, the leading edge sensor 32 has sensed a leading or front edge 34 of the dye receiver sheet 12 and activated the capstan roller 28 to cause that roller and the pinch roller 30 to advance the receiver sheet forward onto an intermediate tray 36. The receiver sheet 12 is advanced forward into the intermediate tray 36 so that the trailing or rear edge 26 of the receiver sheet can be moved beyond a hinged exit door 38 which is a longitudinal extension of the curved guide 20. Then, as illustrated, the hinged exit door 38 closes and the capstan and pinch rollers 28 and 30 are reversed to advance the receiver sheet 12 rearward, i.e. rear edge 26 first, partially into a rewind chamber 40.

To make a print, the various color dyes in the dye transfer areas 5 of a single series of the color sections 2, 3 and 4 on the donor web 1 must be successively heat-transferred onto the dye receiver sheet 12. This is shown in FIGS. 4 and 5.

Figure 4:
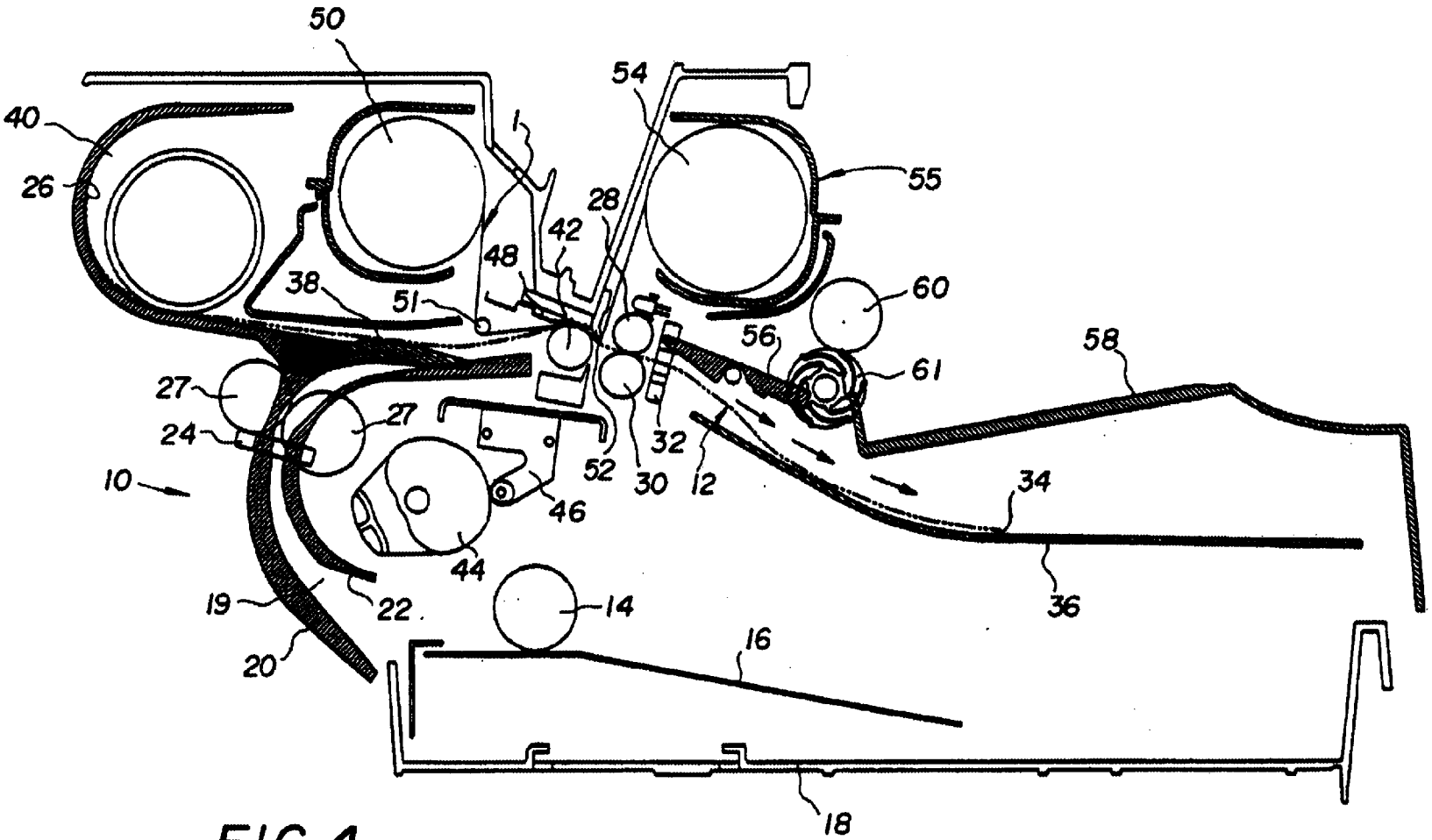

In FIG. 4, a platen roller 42 is shifted via a rotated cam 44 and a platen lift 46 to adjacent a thermal print head 48 This causes the dye receiver sheet 12 and a first one of the successive color sections 2, 3, and 4 of the donor web 1 to be locally held together between the platen roller 42 and the print head 48 The capstan and pinch rollers 28 and 30 are reversed to again advance the dye receiver sheet 12 forward to begin to return the receiver sheet to the intermediate tray 36. At the same time, the donor web 1 is advanced forward under a longitudinal tension, from a donor supply spool 50, over a first stationary (fixed) web guide 51, the print head 48 and a second stationary (fixed) web guide or guide nose 52, and then onto a donor take-up spool 54. The donor supply and take-up spools 50 and 54 together with the donor web 1 are provided in a replaceable cartridge 55 that is loaded into the printer 10.

When the first one of the successive color sections 2, 3 and 4 of the donor web 1 is moved forward in intimate contact with the print head 48 in FIG. 4, the color dye in the dye transfer area 5 of that color section is heat-transferred onto the dye receiver sheet 12. The dye transfer from the transfer area 5 to the receiver sheet 12 is done line-by-line widthwise across the transfer area via a bead of selectively heated resistive elements (not shown) on the print head 48 The print head 48 makes line contact across the entire width W of the first color section 2 as depicted in FIG. 5 (the guide nose 52 and the dye receiver sheet 12 are not shown). However, the print head 48 only heats the dye transfer area 5, i.e. it does not heat two edge areas 6 and 7 alongside the transfer area.

Figure 5:
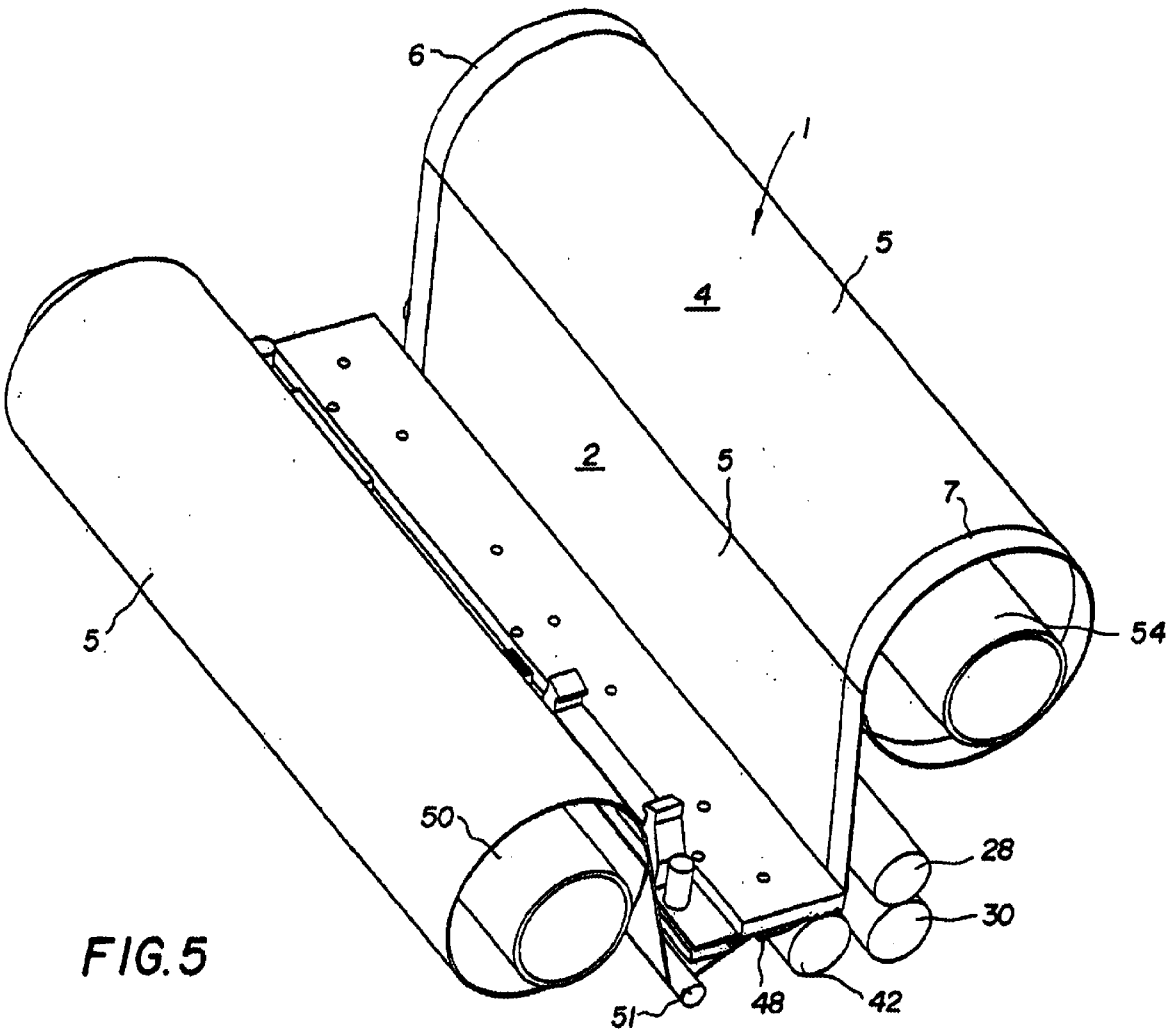
FIG. 5 is perspective view of a printing or dye transfer station in the dye transfer printer.

As the first color section 2 is used for dye transfer line-by-line, it moves from the print head 48 and over the guide nose 52 in FIGS. 4 and 5. Then, once the dye transfer for the first color section 2 is completed, the platen roller 42 is shifted via the rotated cam 44 and the platen lift 46 from adjacent the print head 48 to separate the platen roller from the print head. This is shown in FIG. 3.

Then, the capstan and pinch rollers 28 and 30 are reversed to advance the dye receiver sheet 12 rearward, i.e. trailing or rear edge 26 first, partially into the rewind chamber 40 and the used color section 2 is wrapped about the donor take-up spool 54. See FIG. 3.

Then, the cycle in FIG. 4 is repeated with the next (fresh) one of the successive color sections 2, 3 and 4.

Once the last one of the successive color sections 2, 3 and 4 is used, the dye transfer to the dye receiver sheet 12 is completed. Then, in FIG. 3, the platen roller 42 is shifted via the rotated cam 44 and the platen lift 46 from adjacent the print head 48 to separate the platen roller from the print head, the capstan and pinch rollers 28 and 30 are reversed to advance the receiver sheet 12 rearward, i.e. trailing or rear edge 26 first, partially into the rewind chamber 40, and the last color section 4 is wrapped about the donor take-up spool 54.

Figure 6:
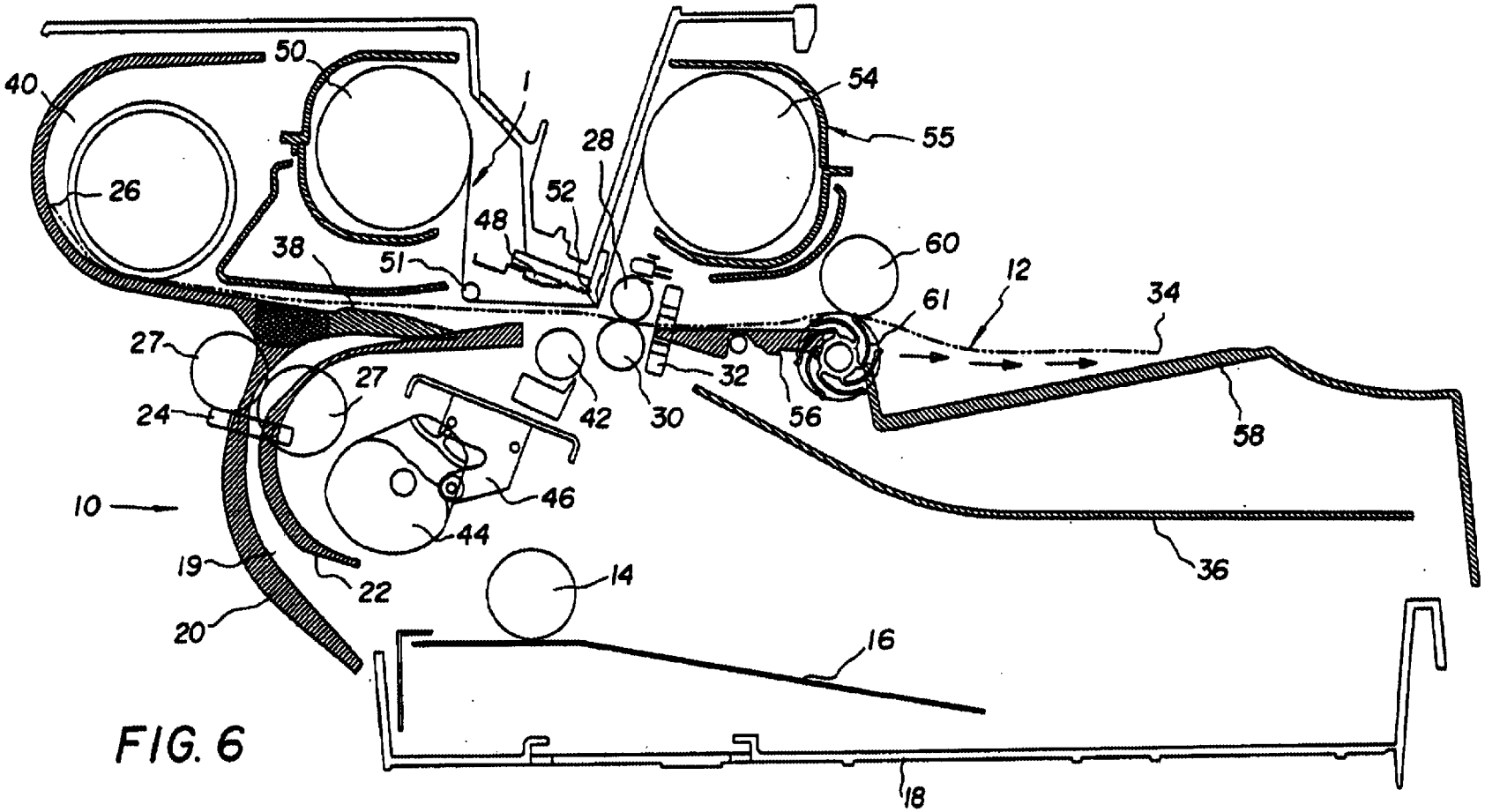
FIG. 6 is an elevation section view of the dye transfer printer as in FIG. 2, showing a final cycle during the printer operation.

Finally, as shown in FIG. 6, the platen roller 42 remains separated from the print head 48 and the capstan and pinch rollers 28 and 30 are reversed to again advance the dye receiver sheet 12 forward. However, in this instance a diverter 56 is pivoted to divert the receiver sheet 12 to an exit tray 58 instead of returning the receiver sheet to the intermediate tray 36 as in FIG. 4. A pair of parallel axis exit rollers 60 and 62 aid in advancing the receiver sheet 12 into the exit tray 58.

Prior Art Problem

Figure 7:
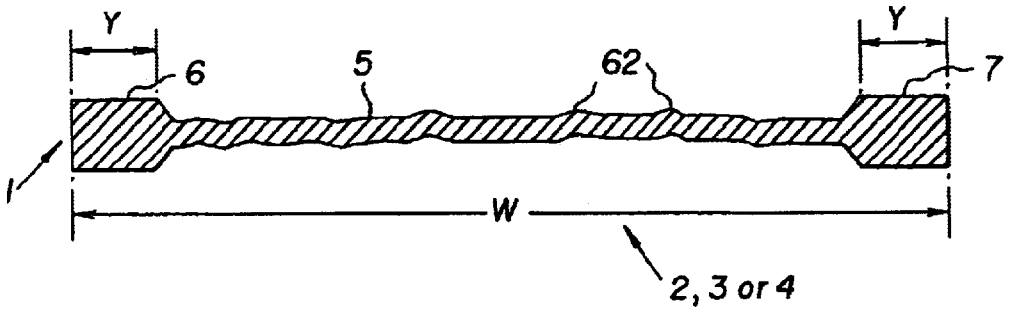
FIG. 7 is a cross section view of the donor web when the dye transfer area has been stretched thinner than the two edge areas alongside the dye transfer area, showing a wave-like or ripple distortion widthwise between the edge areas.

As each one in a single series of the color sections 2, 3 and 4 of the donor web 1 is successively used for dye transfer at the print head 48 in FIGS. 4 and 5, it is stretched lengthwise under tension, particularly over the second stationary (fixed) web guide or guide nose 52. Since the dye transfer area 5 in a used color section 2, 3 or 4 has been heated by the print head 48, but the two edge areas 6 and 7 alongside the transfer area have not been heated, the transfer area tends to be stretched under tension more than the edge areas. As a result, the dye transfer area 5 becomes thinner than the two edge areas and develops a wave-like or ripple distortion 62 widthwise between the edge areas. This is shown in FIG. 7.

Figure 8:
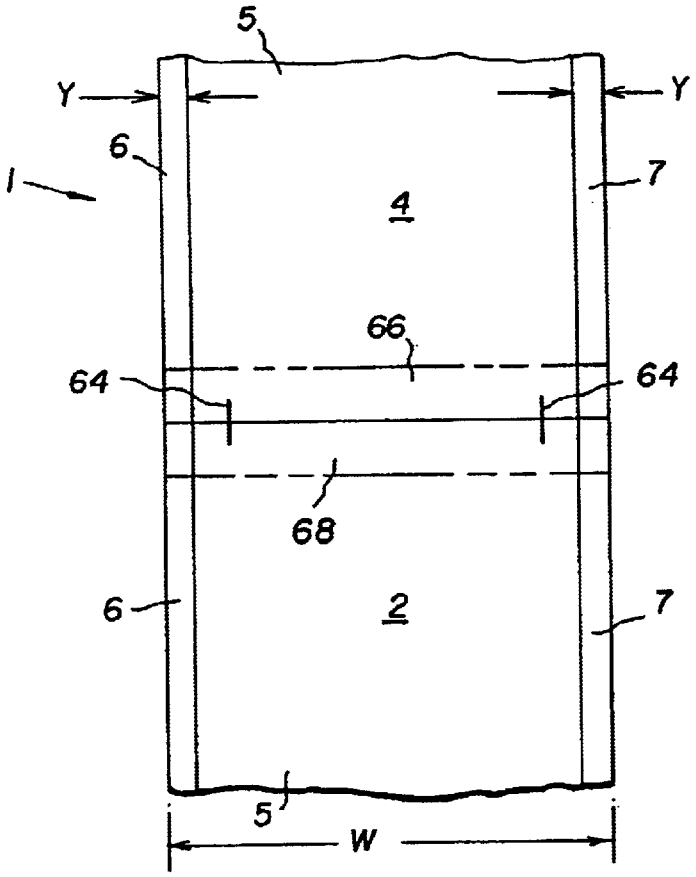
FIG. 8 is a plan view of the donor web, showing creases spreading rearward from a trailing or rear end portion of a used transfer area into a leading or front end portion of an unused transfer area in the next (fresh) color section.

After the last line is transferred from a dye transfer area 5 to the dye receiver sheet 12, and as the used color section 2, 3 or 4 is advanced forward from the print head 48, over the guide nose 52, and onto the donor take-up spool 54, the wave-like or ripple distortion 62 in the transfer area causes one or more creases 64 to be formed at least in a short trailing or rear end portion 66 of the transfer area that has not been used for dye transfer. See FIG. 8. The creases 64 tend to spread rearward from the trailing or rear end portion 66 of the used transfer area 5 into a leading or front end portion 68 of an unused transfer area 5 in the next (fresh) color section 2, 3 or 4 being advanced to the print head 48. The creases 64 appear to be created because of the difference in thickness between the used transfer area 5 and the edge areas 6 and 7 as they are wound under tension from the print head 48, over the guide nose 42, and onto the donor take-up spool 54.

Figure 9:
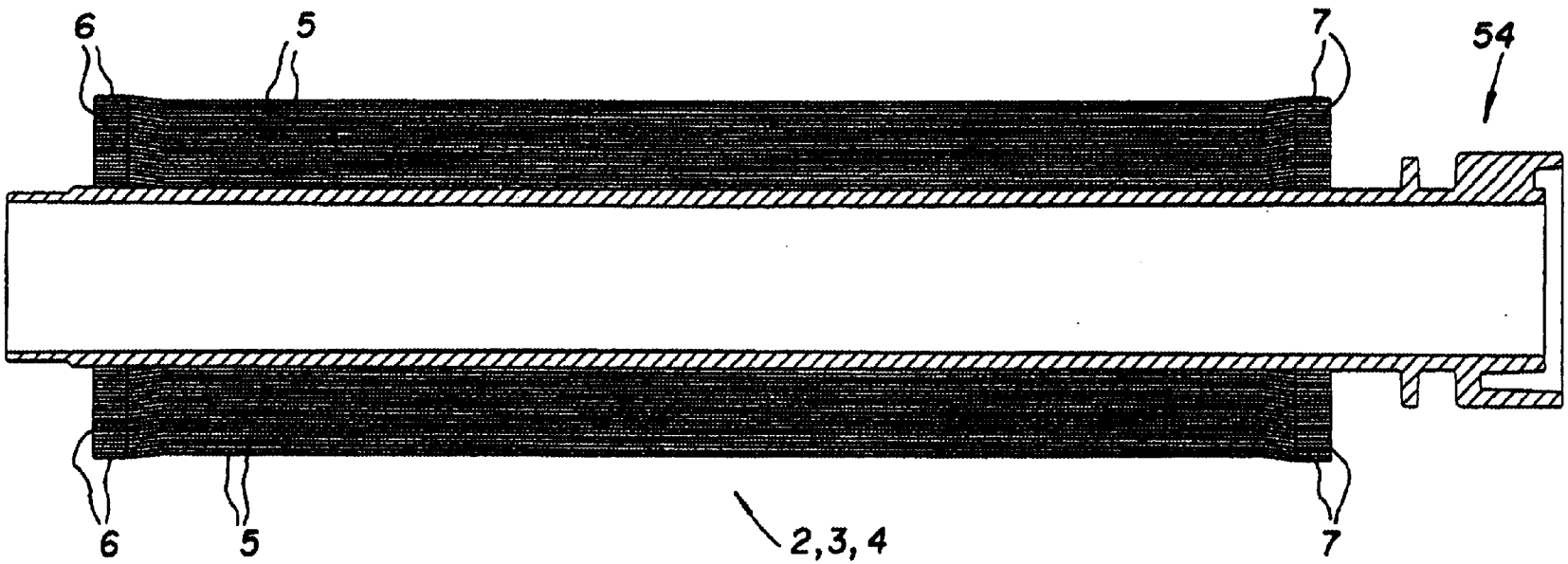
FIG. 9 is a cross-section view of a prior art donor take-up spool in the dye transfer printer.

When a used color section 2, 3 or 4 is wrapped under tension around the donor take-up spool 54, the two edge areas 6 and 7 wrap differently on the spool than does the used transfer area 5 because of the difference in thickness between the transfer area and the edge areas. See FIGS. 7 and 9. As each additional color section 2, 3 or 4 is wrapped around the donor take-up spool 54, the convolution build-up of the thicker edge areas 6 and 7 on the spool becomes significantly greater than the convolution build-up of the thinner transfer areas 5. See FIG. 9. This non-uniform winding of the used color section increases the likelihood of one or more of the creases 64, shown in FIG. 8, being created because the convolution build-up of the thicker edge areas 6 and 7 on the donor take-up spool 54 adds to the tension and distortion of the used transfer areas 5.

Figure 10:
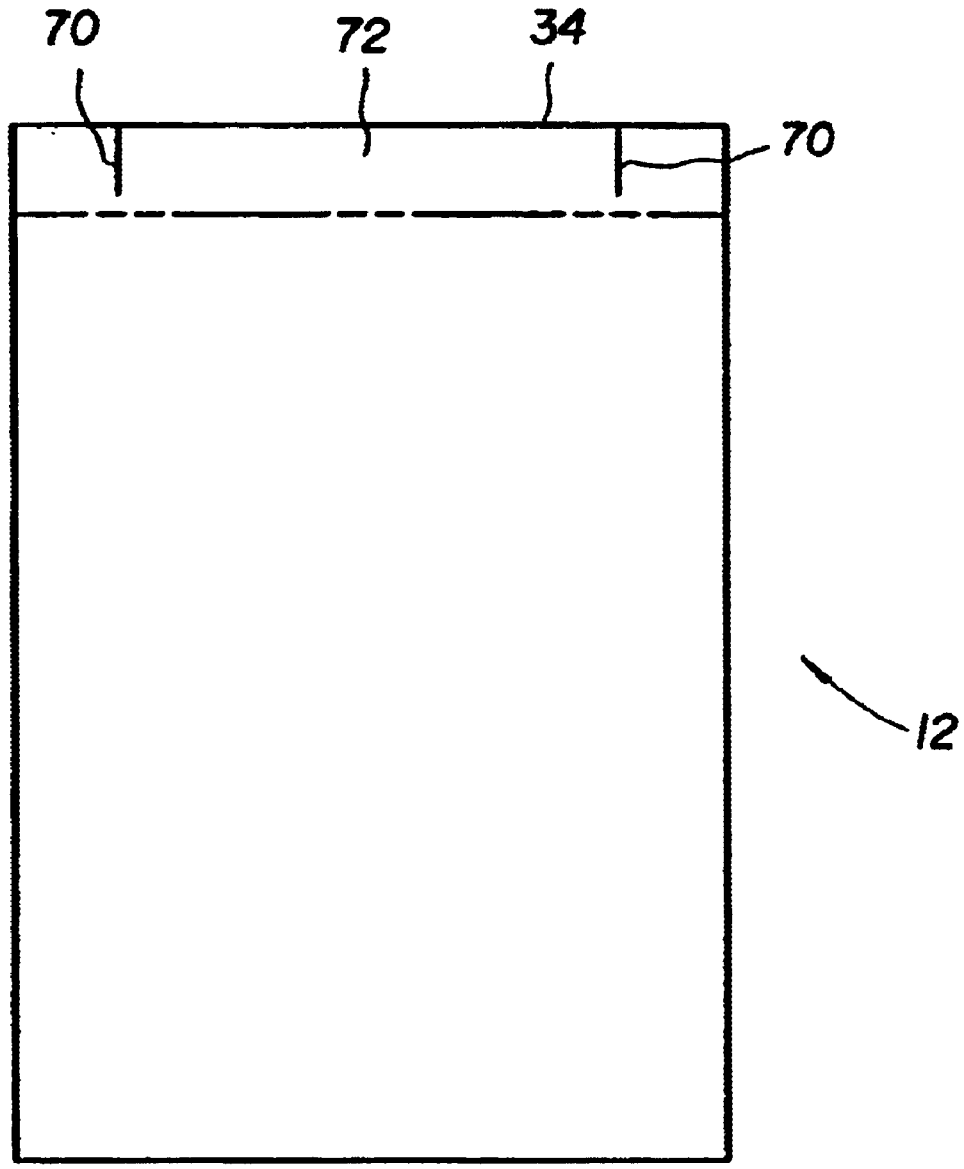
FIG. 10 is a plan view of a dye receiver sheet, showing line artifacts printed on a leading or front edge portion of the receiver sheet.

A problem that can result is that a crease 64 in the leading or front end portion 68 of the unused transfer area 5 of the next (fresh) color section 2, 3 or 4 will cause an undesirable line artifact 70 to be printed on a leading or front end portion 72 of the dye receiver sheet 12 when the print head 48 is applied to the crease. See FIG. 10. The line artifact 70 printed on the dye receiver sheet 12 is about 0.5 inches in length.

The question presented therefore is how to solve the problem of the creases 64 being created in the unused transfer area 5 of each fresh color section 2, 3 or 4 so that no line artifacts 70 are printed on the dye receiver sheet 12.

Solution

Figure 11:
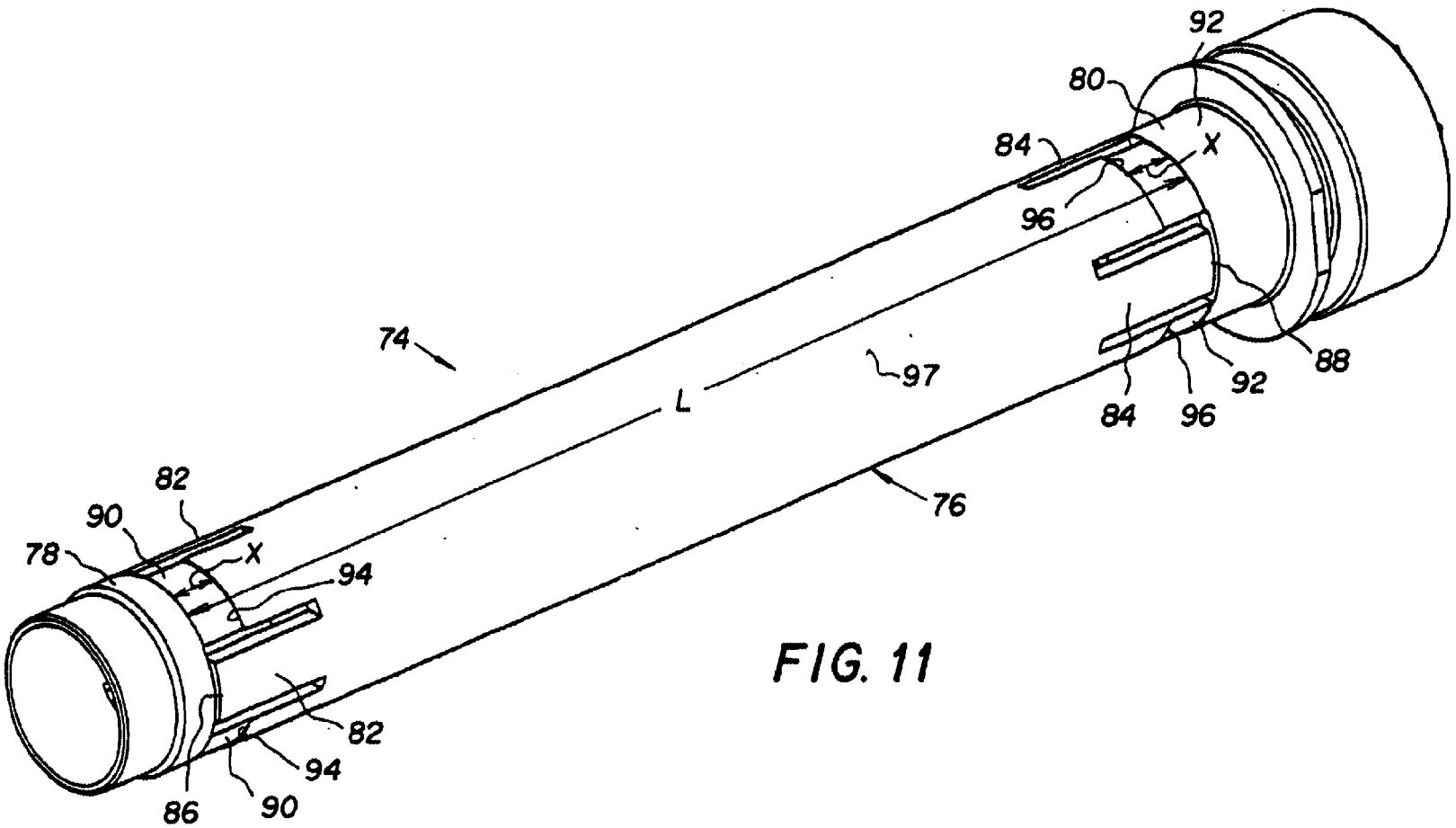
FIG. 11 is perspective view of an improved donor take-up spool to be used in the dye transfer printer in place of the prior art donor take-up spool, according to a preferred embodiment of the invention.
Figure 12:
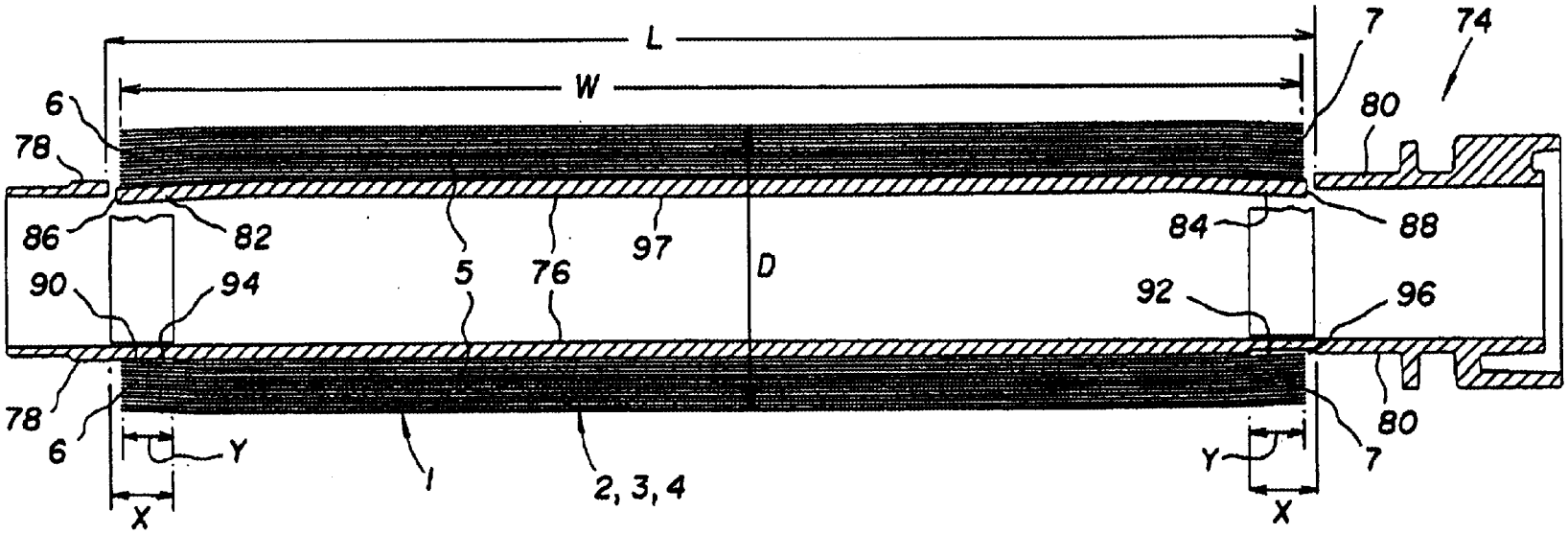
FIG. 12 is a cross-section view of the improved donor take-up spool.

FIGS. 11 and 12 depict a donor take-up spool 74 that is an improvement over the donor take-up spool 54 in the printer 10. The donor take-up spool 74 is intended to replace the donor take-up spool 54 in the printer 10.

The improved donor take-up spool 74 includes a hollow cylindrical core 76 and opposite cylindrical end portions 78 and 80. See FIG. 11. The cylindrical spool core 76 has three resilient, flexible, cantilevered fingers 82 close to the cylindrical spool end portion 78 and the same number of resilient, flexible, cantilevered fingers 84 close to the spool end portion 80. Each one of the cantilevered fingers 82 is integrally formed with the spool core 76, is curved widthwise in co-planar conformity with the spool core, is spaced evenly (120°) from the next finger, and longitudinally extends so that a free end 86 of the finger is slightly spaced from the spool end portion 78. Each one of the cantilevered fingers 84 is integrally formed with the spool core 76, is curved widthwise in co-planar conformity with the spool core, is spaced evenly (120°) from the next finger, and longitudinally extends so that a free end 88 of the finger is slightly spaced from the spool end portion 80. The spool core 76 has respective web edge support surfaces 90 that longitudinally extend curved between each one of the cantilevered fingers 82, and similar web edge support surfaces 92 that longitudinally extend curved between each one of the cantilevered fingers 84. The three web edge support surfaces 90 are set inward relative to the three cantilevered fingers 82 in respective cavities 94 in the spool core 76, so that the fingers can be bent (depressed) inward beginning at their free ends 86 to be substantially in-line with the web edge support surfaces 90. See FIG. 12. The three web edge support surfaces 92 are set inward relative to the three cantilevered fingers 84 in respective cavities 96 in the spool core, so that the fingers can be bent (depressed) inward beginning at their free ends 88 to be substantially in-line with these the web edge support surfaces 92.

The length L of the spool core 76, between the cylindrical end portions 78 and 80, is slightly greater than the width W of the donor web 1 and the width X of each one of the web support surfaces 90 and 92 is slightly greater than the width Y of each one of the edge areas 6 and 7 of the donor web. See FIGS. 1, 11 and 12.

As each used color section 2, 3 or 4 is wrapped under tension successively around the spool core 76, the edge areas 6 and 7 do not wrap differently on the spool core than does the used transfer areas 5 (as in the case of the donor take-up spool 54, shown in FIGS. 2–6 and 9, due to the difference in thickness between the edge areas and the transfer areas).

The thicker edge areas 6 and 7 and the thinner transfer areas 5 when wrapped around the spool core 76 will have a substantially common wrap diameter D as shown in FIG. 12. This is because the thicker edge areas 6 will bend (depress) the three cantilevered fingers 82 inward beginning at their free ends 86, and the thicker edge areas 7 will bend (depress) the three cantilevered fingers 84 inward beginning at their free ends 88. This allows the thicker edge areas 6 to drop successively into the three cavities 94 (and move toward the three web support surfaces 90), and allows the thicker edge areas 7 to drop successively into the three cavities 96 (and move inward toward the three web support surfaces 92). An intermediate portion 97 of the spool core 76 longitudinally extending between the fingers 82 and 84 is not depressed like the fingers. Thus, the convolution build-up of the thicker edge areas 6 and 7 will be no more than substantially the same as the convolution build-up of the thinner transfer areas 5 on the spool core 76 since the winding of the used color sections 2, 3 and 4 on the spool core 76 will be substantially uniform.

Accordingly, the likelihood of one or more of the creases 64 being formed in a used transfer area 5 and spreading to the next transfer area is substantially prevented since there will be less tension and distortion of the used transfer area.

The possibility of a line artifact 70 being printed on the dye receiver sheet 1 therefore is substantially eliminated.

Variations Of Spool Core 76

The invention has been described in detail with particular reference to certain preferred embodiments thereof, but it will be understood that variations and modifications can be effected within the spirit and scope of the invention. For example, the number of cantilevered fingers 82 and the number of cantilevered fingers 84 need not be three. The number can vary preferably from three to as many as can fit on the spool core 76.

Figure 13:
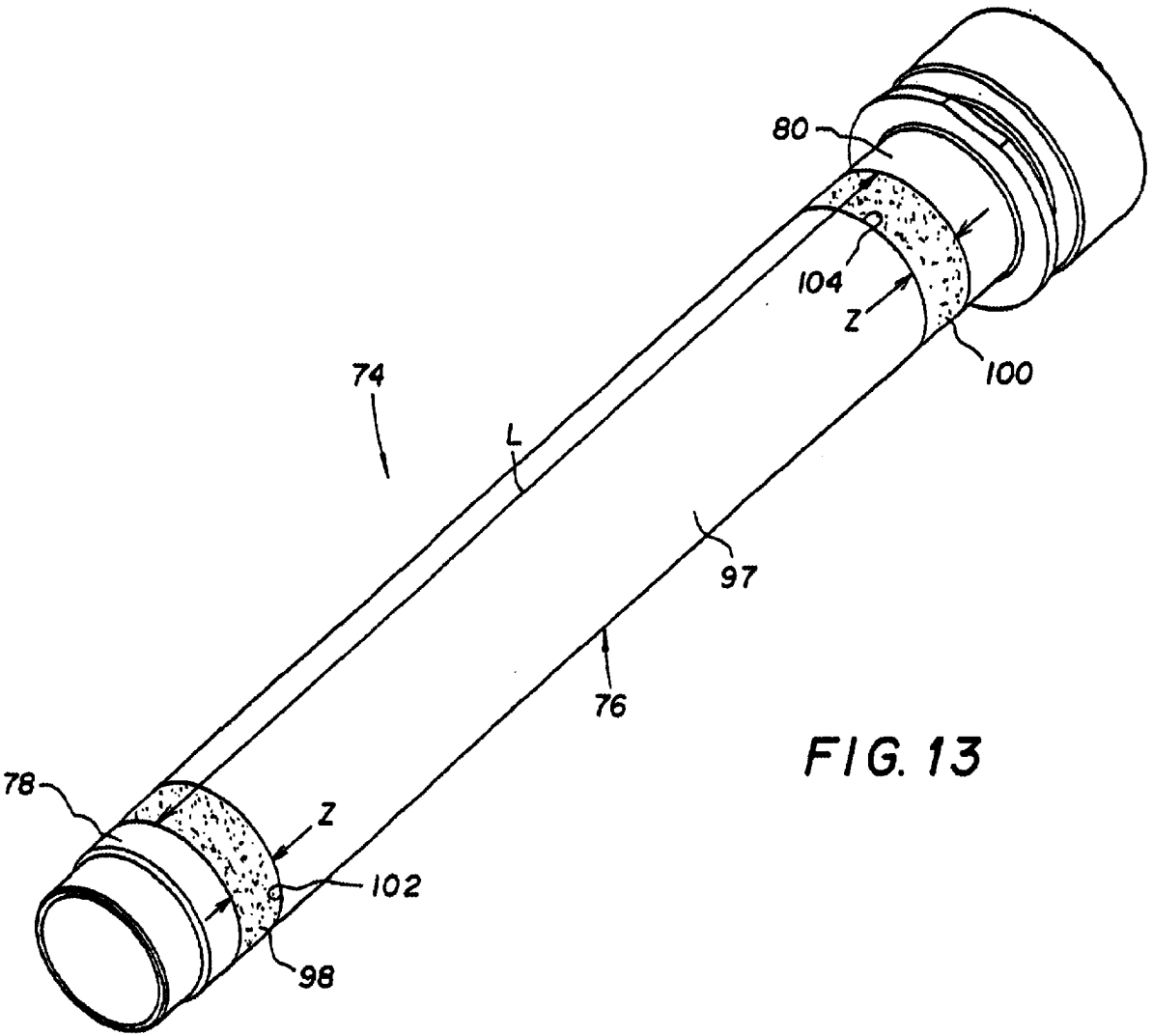
FIG. 13 is perspective view of an alternate version of the improved donor take-up spool.
Figure 14:
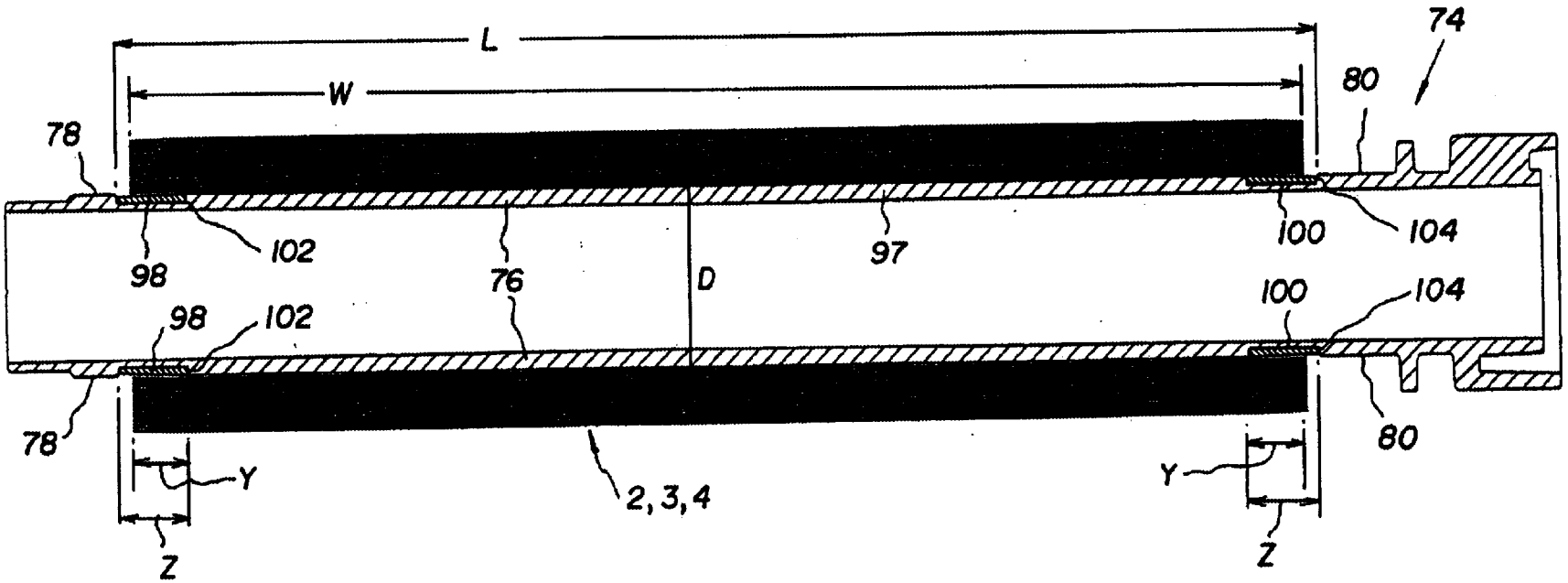
FIG. 14 is a cross-section view of the alternate version of the improved donor take-up spool.

Also, as shown in FIGS. 13 and 14, in place of the three cantilevered fingers 82 there is a single annular compressible (rubber) sleeve 98 for supporting the edge area 6 of the donor web 1, and in place of the three cantilevered fingers 84 there is a similar sleeve 100 for supporting the edge area 7 of the donor web. The width Z of each one of the sleeves 98 and 100 is slightly greater than the width Y of each one of the edge areas 6 and 7, and the sleeves reside in respective annular cavities 102 and 104 in the spool core 76 adjacent the spool end portions 78 and 80. As each used color section 2, 3 or 4 is wrapped under tension successively around the spool core 76, the edge areas 6 and 7 do not wrap differently on the spool core than does the used transfer areas 5 because the edge areas will compress the sleeves 98 and 100 inward (similar to the way the edge areas depress the cantilevered fingers 82 and 84 inward beginning at their free ends 86 and 88 in FIG. 12). ). An intermediate portion 106 of the spool core 76 longitudinally extending between the sleeves 98 and 100 is not compressed like the sleeves.

PARTS LIST

| | |
|---|---|
| 1. | donor web |
| 2. | cyan color section |
| 3. | magenta color section |
| 4. | yellow color section |
| 5. | dye transfer area |
| 6. | longitudinal edge area |

-continued

PARTS LIST

| | |
|---|---|
| 7. | longitudinal edge area |
| W. | web width |
| 10. | thermal printer |
| 12. | dye receiver sheet |
| 14. | pick rollers |
| 16. | platen |
| 18. | tray |
| 19. | channel |
| 20. | longitudinal guide |
| 22. | longitudinal guide |
| 24. | trailing edge sensor |
| 26. | trailing edge |
| 27. | urge rollers |
| 28. | capstan roller |
| 30. | pinch roller |
| 32. | leading edge sensor |
| 34. | leading or front edge |
| 36. | intermediate tray |
| 38. | exit door |
| 40. | rewind chamber |
| 42. | platen roller |
| 44. | cam |
| 46. | platen lift |
| 48. | print head |
| 50. | donor supply spool |
| 51. | first stationary (fixed) web guide |
| 52. | second stationary (fixed) web guide or guide nose |
| 54. | donor take-up spool |
| 55. | cartridge |
| 56. | diverter |
| 58. | exit tray |
| 60. | exit roller |
| 61. | exit roller |
| 62. | wave-like or ripple distortion |
| 64. | creases |
| 66. | trailing or rear end portion |
| 68. | leading or front end portion |
| 70. | line artifacts |
| 72. | leading or front end portion |
| 74. | improved donor take-up spool |
| 76. | spool core |
| 78. | spool end portion |
| 80. | spool end portion |
| 82. | fingers |
| 84. | fingers |
| 86. | free ends |
| 88. | free ends |
| 90. | web edge support surfaces |
| 92. | web edge support surfaces |
| 94. | cavities |
| 96. | cavities |
| L. | length |
| X. | width |
| Y. | width |
| D. | wrap diameter |
| 97. | intermediate portion |
| 98. | sleeve |
| 100. | sleeve |
| Z. | width |
| 102. | cavity |
| 104. | cavity |

What is claimed is:

1. A dye transfer printer in which a donor web having successive dye transfer areas that are used for printing and opposite longitudinal edge areas alongside each one of the dye transfer areas that are not used for printing are wrapped under longitudinal tension about a cylindrical spool core, and in which the dye transfer areas that are wrapped under tension about said spool core have been stretched thinner than the two edge areas that are wrapped under tension about said spool core, is characterized in that:

said cylindrical spool core is depressible inward at respective portions on which the two edge areas are wrapped under tension about said spool core and is not depressible at an intermediate portion between said depressible portions on which the thinner transfer areas are wrapped under tension about said spool core, whereby a convolution build-up of the edge areas on said spool core will be no more than a convolution build-up of the thinner transfer areas on said spool core.

2. A dye transfer area as recited in claim 1, wherein said depressible portions include flexible cantilevered fingers about which the two edge areas are wrapped under tension and which are depressed inward by the two edge areas wrapping about said fingers.

3. A dye transfer area as recited in claim 2, said cantilevered fingers are curved widthwise in co-planar conformity with said cylindrical spool core.

4. A dye transfer printer as recited in claim 3, wherein said spool core has opposite cylindrical end portions, and each of said cantilevered fingers longitudinally extends so that a free end of the finger is slightly spaced from one of said spool end portions.

5. A dye transfer printer as recited in claim 2, wherein said cylindrical spool core has web edge support surfaces that longitudinally extend curved between said cantilevered fingers.

6. A dye transfer printer as recited in claim 5, wherein said web edge support surfaces are set inward relative to said cantilevered fingers in respective cavities in said cylindrical spool core so that said fingers can be depressed inward to be substantially in-line with said web edge support surfaces.

7. A dye transfer printer as recited in claim 6, wherein each of said web support surfaces has a width that is slightly greater than the width of each of the edge areas.

8. A dye transfer printer as recited in claim 1, wherein said depressible portions include annular compressible sleeves about which the two edge areas are wrapped under tension and which are compressed inward by the two edge areas wrapping about said sleeves.

9. A dye transfer printer as recited in claim 8, wherein said annular sleeves reside in respective cavities in said cylindrical spool core.

10. A web winding method for a dye transfer printer in which a donor web having successive dye transfer areas that are used for printing and opposite longitudinal edge areas alongside each one of the dye transfer areas that are not used for printing are wrapped under longitudinal tension about a cylindrical spool core, and in which the dye transfer areas that are wrapped under tension about the spool core have been stretched thinner than the two edge areas that are wrapped under tension about the spool core, said web winding method comprising:

depressing the cylindrical spool core inward at respective portions on which the two edge areas are wrapped under tension about the spool core and not depressing the spool core at an intermediate portion between the depressible portions on which the thinner transfer areas are wrapped under tension about the spool core, whereby a convolution build-up of the edge areas on the spool core will be no more than a convolution build-up of the thinner transfer areas on the spool core.

11. A web winding method as recited in claim 10, wherein the cylindrical spool core is depressed inward at respective portions on which the two edge areas are wrapped under tension about the spool core by wrapping the edge areas under tension about flexible cantilevered fingers on the spool core and bending the cantilevered fingers inward.

12. A web winding method as recited in claim 10, wherein the cylindrical spool core is depressed inward at respective portions on which the two edge areas are wrapped under tension about the spool core by wrapping the edge areas under tension about compressible sleeves on the spool core and compressing the sleeves inward.

13. A dye transfer printer in which a donor web having successive dye transfer areas that are used for printing and opposite longitudinal edge areas alongside each one of the dye transfer areas that are not used for printing are wrapped under longitudinal tension about a cylindrical spool core, and in which the dye transfer areas that are wrapped under tension about said spool core have been stretched thinner than the two edge areas that are wrapped under tension about said spool core, is characterized in that:

said cylindrical spool core has spaced web edge support means for being depressed inward by the two edge areas when the edge areas are wrapped under tension about said spool core, and is not depressible at an intermediate portion between said means on which the thinner transfer areas are wrapped under tension about said spool core, whereby a convolution build-up of the edge areas on said spool core will be no more than a convolution build-up of the thinner transfer areas on said spool core.

14. A dye transfer printer in which a donor web having successive dye transfer areas that are used for printing and opposite longitudinal edge areas alongside each one of the dye transfer areas that are not used for printing are wrapped under longitudinal tension about a cylindrical spool core, and in which the dye transfer areas that are wrapped under tension about said spool core have been stretched thinner than the two edge areas that are wrapped under tension about said spool core, is characterized in that:

said cylindrical spool core is depressible inward at cantilevered fingers on which the two edge areas are wrapped under tension about said spool core and is not depressible at an intermediate portion between said fingers portions on which the thinner transfer areas are wrapped under tension about said spool core, and web edge support surfaces for the two edge areas are set inward relative to said cantilevered fingers in respective cavities so that said fingers can be depressed inward to be substantially in-line with said web edge support surfaces, whereby a convolution build-up of the edge areas on said spool core will be no more than a convolution build-up of the thinner transfer areas on said spool core.

15. A dye transfer printer in which a donor web having successive dye transfer areas that are used for printing and opposite longitudinal edge areas alongside each one of the dye transfer areas that are not used for printing are wrapped under longitudinal tension about a cylindrical spool core, and in which the dye transfer areas that are wrapped under tension about said spool core have been stretched thinner than the two edge areas that are wrapped under tension about said spool core, is characterized in that:

said cylindrical spool core is depressible inward at respective annular compressible portions on which the two edge areas are wrapped under tension about said spool core to depress said sleeves and is not depressible at an intermediate portion between said sleeves on which the thinner transfer areas are wrapped under tension about said spool core, whereby a convolution build-up of the edge areas on said spool core will be no more than a convolution build-up of the thinner transfer areas on said spool core.

* * * * *